US005923942A

United States Patent [19]

Nuggehalli et al.

[11] Patent Number: 5,923,942

[45] Date of Patent: Jul. 13, 1999

[54] PRINTER AND PAPER TRAY HAVING A USER PROGRAMMABLE PAPER SIZE

[75] Inventors: Jayasimha Nuggehalli; Yumin Chung, both of San Jose, Calif.

[73] Assignee: Ricoh Company, Ltd., Tokyo, Japan

[21] Appl. No.: 08/970,623

[22] Filed: Nov. 14, 1997

[51] Int. Cl.[6] ..... G03G 15/00

[52] U.S. Cl. ..... 399/389; 399/393

[58] Field of Search ..... 399/16, 23, 81, 399/361, 381, 389, 391, 393

[56] References Cited

U.S. PATENT DOCUMENTS

| | | | |
|---|---|---|---|
| 4,008,957 | 2/1977 | Summers | 399/23 |
| 4,780,740 | 10/1988 | Fukae | 399/393 X |
| 4,933,720 | 6/1990 | Takano et al. | 399/389 |
| 5,121,169 | 6/1992 | Kawabata | 399/389 |
| 5,172,178 | 12/1992 | Oushiden et al. | 399/389 X |
| 5,574,551 | 11/1996 | Kazakoff | 399/23 X |

*Primary Examiner*—Sandra Brase
*Attorney, Agent, or Firm*—Oblon, Spivak, McClelland, Maier & Neustadt, P.C.

[57] ABSTRACT

A printing device that includes a paper tray having adjustability for any number of paper sizes and a dial indicator that includes a predetermined number of standard or precut paper sizes and a setting that invokes a menu from which a user can select from an extended list of standard or precut paper sizes. The menu for selection of extended standard/precut paper sizes includes a setting which invokes a second menu from which a custom cut page size may be entered. The printer retrieves selected paper size or custom cut page size based on inputs from the menu and stores the retrieved sizes in memory so that the paper tray has an identified paper size located therein.

19 Claims, 9 Drawing Sheets

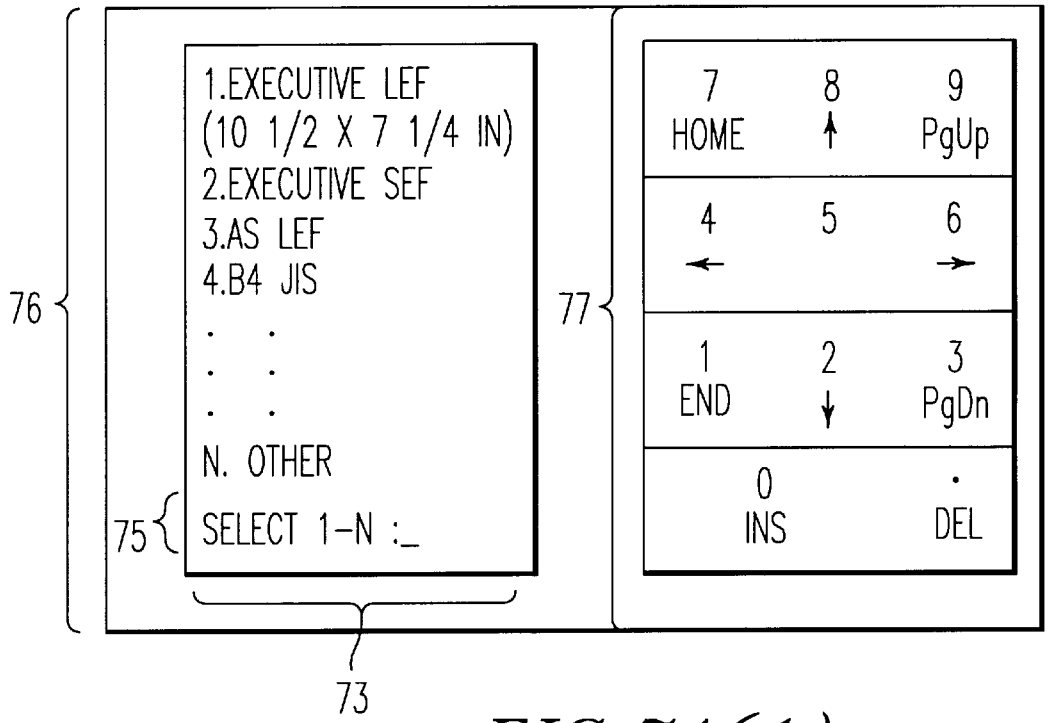
FIG. 7A(1)
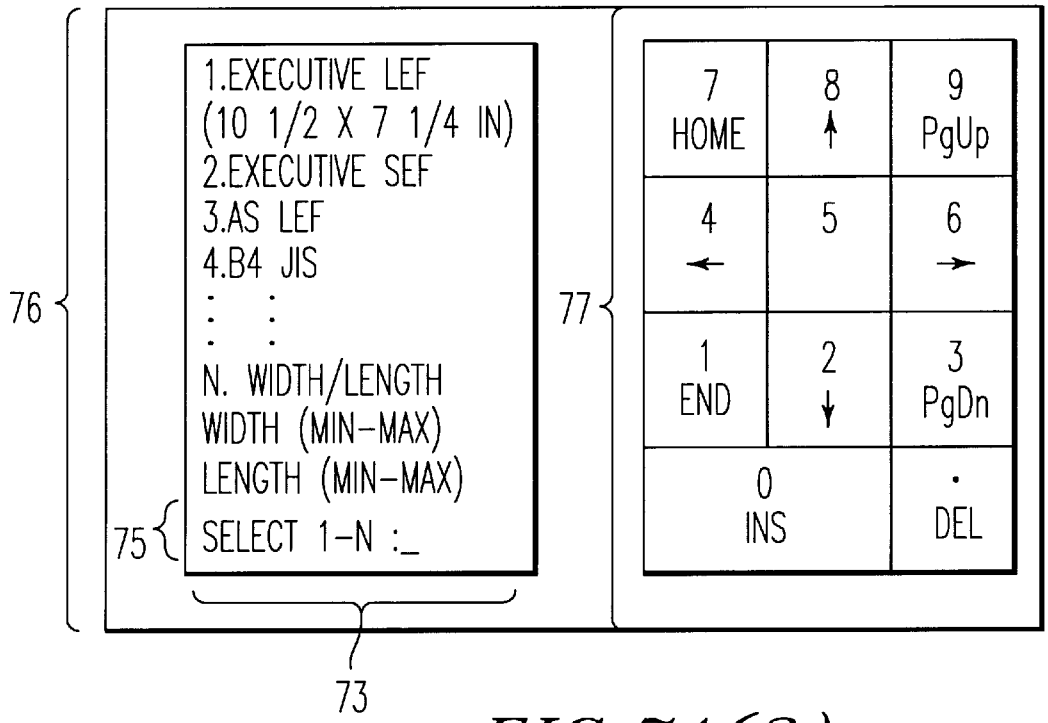
FIG. 7A(2)

PRINTER AND PAPER TRAY HAVING A USER PROGRAMMABLE PAPER SIZE

BACKGROUND OF THE INVENTION

1. Field of the Invention

This invention relates to a printer having an adjustable paper tray or cassette that is user programmable as to a size of paper loaded therein. The invention is more particularly related to a printer utilizing an adjustable paper tray having a user selectable switch having positions for identification of one of plural predetermined paper sizes and an alternate position for identification of a paper size that is user selectable from a menu or other alternate selection means associated with the printer. The invention is still further related to a printer having an adjustable paper tray that accepts custom size paper and is user programmable such that custom size paper loaded is registered in the printer as being loaded into the adjustable paper tray.

2. Discussion of the Background

One of the increasing demands placed on computer related equipment in both home, school, and work environments is increased flexibility to perform varied tasks. Printers are utilized to print reports, faxes, books, pamphlets, overlays, labels, graphics, etc. Each of these items are best presented in a unique format on papers and/or materials of various sizes.

FIG. 1 illustrates a conventional setup of a computer 5 and a printer 1 attached via a cable and/or other network 3. The printer 1 includes a connection port 7 for attaching the cable and/or other network 3 to the printer 1 and a paper tray 9 for storage of paper to be used by the printer 1.

In printing devices, such as the printer 1, it is necessary for a printer engine and printer controller of the printing device to know the size of paper in each input tray. Since a document is imaged to print on a given sized paper, the printer controller needs paper size information in order to select the proper paper tray for printing a document. The printer engine requires the information so that it can properly feed and transport the paper through the printing system.

Some printers use a system of sensors to locate the paper guides or sense the edges of the paper, but this is a complicated and expensive method. Others use special cassettes for each paper size that are encoded in some manner with the paper size, however, this method is cumbersome since a different cassette is needed for each paper size.

Another less complicated and less expensive method is to have the user set a dial or slide associated with a paper tray that indicates the paper size and movable paper guides that can accommodate a range of paper sizes. However, for practical purposes, a dial or slide has a limited number of physical position settings.

FIG. 2 illustrates the details of the paper tray 9 which includes standard or pre-cut paper 11, paper guides 13, position settings 15, position setting identifiers 17, and a dial selector 19. Therefore, when a user needs to print on one of paper sizes A, B, or C corresponding to the position setting identifiers 17, the user moves the paper guides 13 to corresponding position settings 15, and positions the dial selector 19 to a selection corresponding to the position setting identifiers 17 and size of the standard or pre-cut paper 11. The printer 1 then reads the position of the dial selector 19 to register a size of the standard or pre-cut paper 11.

FIG. 3 illustrates a typical page size dialogue 30 which is displayed on a computer monitor and utilized in a conventional computer application. The page size dialog 30 includes a paper size selection box 33, a pull-down selection menu 35, orientation and source identifiers 37, and control buttons 39. Before printing, the user selects a paper size from the pull-down selection menu 35 which is then displayed by the paper size selection box 33 and orientation and size identifiers 37. Control buttons 39 affirm or cancel the users selection and give the user an option of editing, deleting or creating new paper sizes to be displayed in the pull-down selection menu 35.

FIG. 4 illustrates a flowchart for printing on standard or pre-cut paper 11. At step 43 the user loads the standard or pre-cut paper 11 into the paper tray 9 which includes removing the paper tray 9, placing the standard or pre-cut paper 11 in the paper tray 9, and setting the paper guides 13 in position settings 15 corresponding to the size of the standard or pre-cut paper 11. At step 45, the user positions the dial selector 19 to an appropriate position also corresponding to the size of the standard or pre-cut paper 11, and reinserts the paper tray 9 into the printer 1.

At step 47, the user selects a paper size and source for a document or other item to be printed from the page size dialog 30 or other paper size entry means of an application associated with the document or other item to be printed. This step includes invoking the page size dialog 30, selecting a page size from the pull-down selection menu 35 and affirming that selection. For example, utilizing the page size dialog 30, the user may select 8½×11 paper in the paper size selection box 33 and affirm that selection by pressing the OK button from the control buttons 39.

At step 49, the user prints the document by invoking an appropriate graphic button, or other command sequence as ordinarily required by the application associated with the document or other item to be printed.

FIG. 5 illustrates a block diagram of a conventional application 53 interfacing the printer 1. The conventional application 53 is hosted on an operating system 51 resident on the computer workstation 5. When the user invokes a print command from the conventional application 53, the document or other item to be printed is communicated to a printer driver 55. The printer driver 55 is a printer and operating system specific software interface. The operating system 51 sends signals in accordance with instructions from the printer driver 55 to a printer port and/or network card 59 via a printer port cable 57, thus placing signals corresponding to the document or other item to be printed on the cable and/or other network 3 connected to the printer 1.

The above description describes a conventional setup of a computer 5, printer 1, and a conventional application 53 utilizing a print command. Of course, numerous other configurations and variations on specific applications are also known, but have the same basic functionality. However, regardless of configuration, paper trays utilized in modern printers are subject to the limitations described above and cannot accommodate a single paper cassette which can accommodate many varying paper sizes and have the printer know of the existence of the paper size.

SUMMARY OF THE INVENTION

Accordingly, it is an object of this invention to provide a printer having a fully adjustable paper tray or cassette for accommodating paper of standard or pre-cut sizes and being user programmable as to the paper size loaded into the adjustable paper tray or cassette.

It is another object of the invention to provide a printer utilizing a fully adjustable paper tray having a user selectable switch having positions for identification of one of plural standard or pre-cut paper sizes and an alternate position for identification of a paper size that is user selectable from a menu or other alternate selection means.

It is another object of the invention to provide a printer having a fully adjustable paper tray that accepts paper of custom cut sizes and is user programmable so that a custom cut paper size is registered with the printer as being loaded into the paper tray.

These and other objects are accomplished by a printer having an adjustable paper tray and a dial selector having positions for several standard or pre-cut paper sizes and an alternate position which, when set, initiates a user selectable menu in which the user selects one of plural alternate paper sizes identified by the user selectable menu.

Upon selection of paper size, the selected paper size is registered in the printer identifying the size of paper loaded into the paper tray. The printer is then set up for printing on the selected paper size.

Alternatively, the printer may also be set up for custom cut paper sizes not included in the list of paper sizes on the user selectable menu. The user selectable menu is provided with a selection referred to as "other", which when selected, initiates an additional menu in which the user keys in a specific custom cut paper size.

As another alternative, the "other" selection may be replaced with a width/length selection that prompts the user to key in specific width and length values for paper loaded in the paper tray.

Once the printer is set up for printing on either a standard or pre-cut, alternate, or custom cut paper size, the user then follows a normal routine for printing from an application or device associated with a document or other item to be printed.

For example, when using WordPerfect, the user first invokes a page size dialog and selects a page size from the pull-down selection menu. Alternatively, the user creates and selects a custom page size by invoking the appropriate control buttons. Then the user affirms the selection and presses a print graphical icon to invoke a printing operation. If the selected page size of the document being printed matches a paper size registered as being loaded into a paper tray, the paper tray having the corresponding paper size is selected by the printer to provide paper for the printing operation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 7A(1) illustrates a paper size menu and keypad for entering paper sizes; FIG. 7A(2) illustrates an alternative paper size menu having a width and length selection prompt;

DESCRIPTION OF THE PREFERRED EMBODIMENTS

Figure 2:
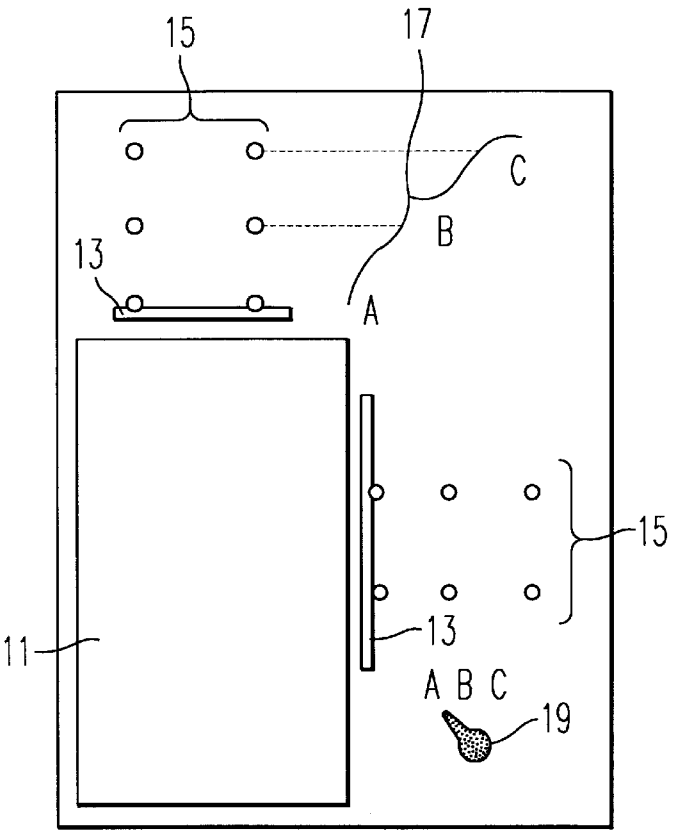
FIG. 2 RELATED ART
FIG. 2 illustrates a conventional paper tray with adjustable paper guides and a dial selector.
Figure 1:
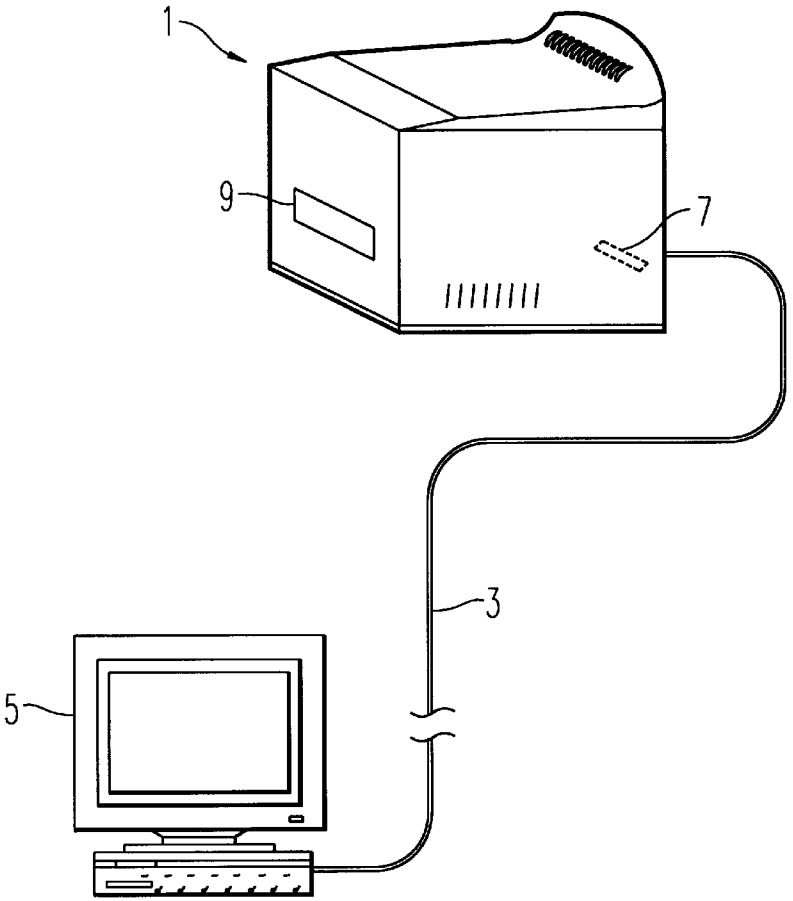
FIG. 1 RELATED ART
FIG. 1 illustrates a conventional computer workstation connected to a printer.
Figure 3:
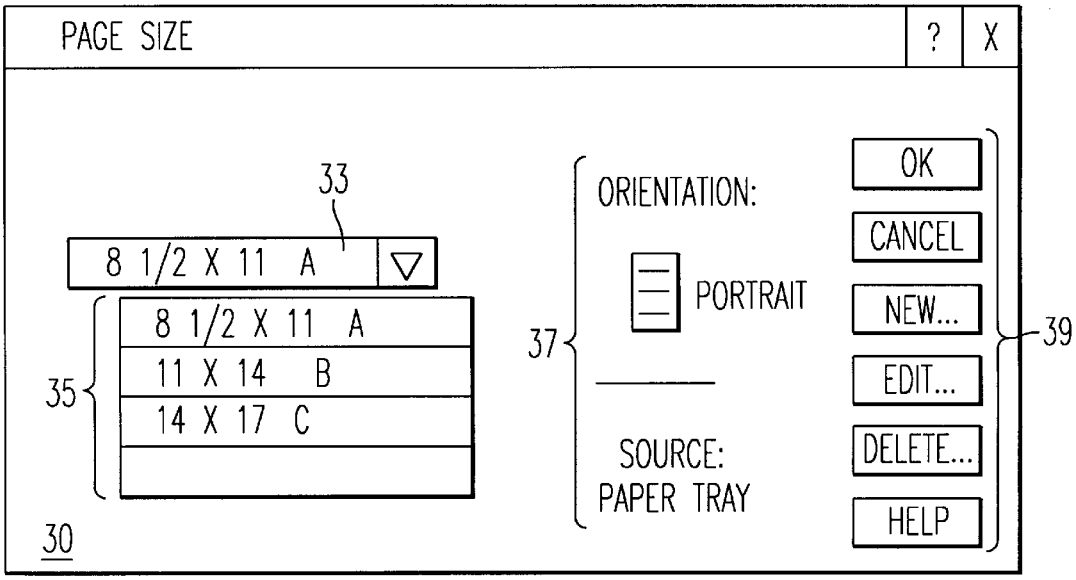
FIG. 3 RELATED ART
FIG. 3 illustrates a conventional page size dialogue applicable to any number of software applications that utilize printers.
Figure 4:
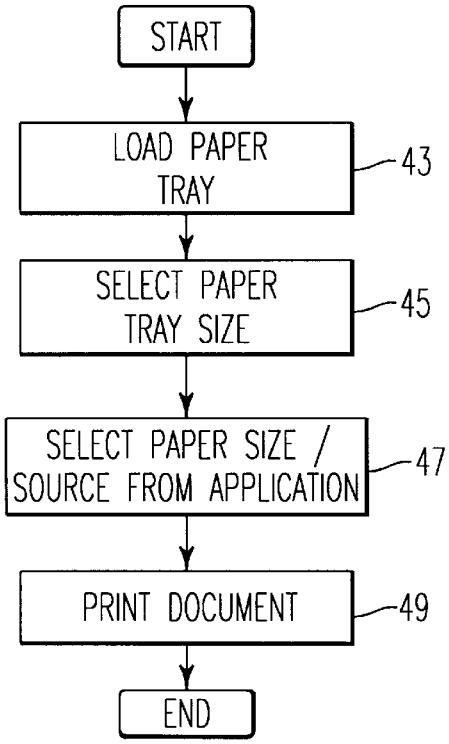
FIG. 4 RELATED ART
FIG. 4 is a flowchart illustrating conventional steps of loading paper into a printer and printing a document from a software application.
Figure 5:
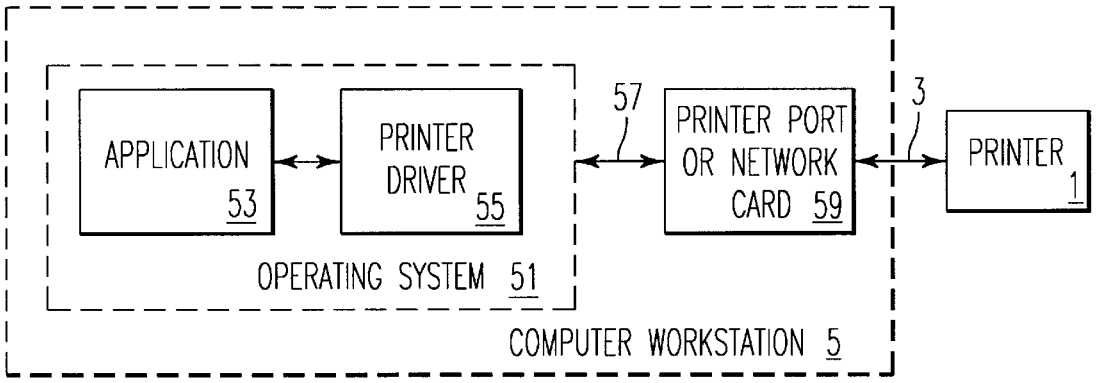
FIG. 5 RELATED ART
FIG. 5 is a block diagram illustrating functional components and data paths between a software application and a printer.
Figure 6A:
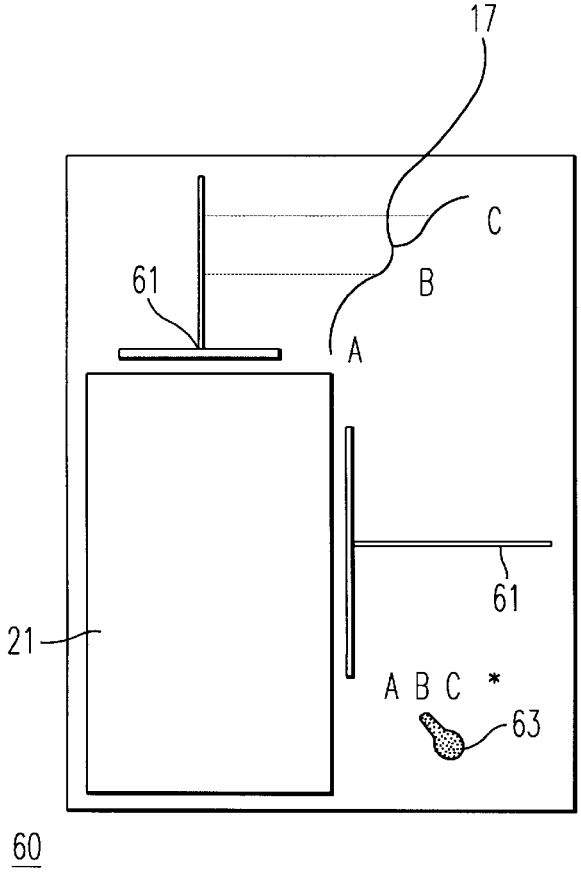
FIG. 6A illustrates a paper tray according to the present invention utilizing adjustable paper guides and a dial selector having an asterisk position.

Referring now to the drawings, wherein like reference numerals designate identical or corresponding parts throughout the several views, and more particularly to FIG. 6A thereof, there is illustrated a new paper tray 60 according to the present invention. The present invention defines a paper tray as anything that holds paper, and a cassette is defined as a paper tray being separable from a printing device and may include a dial for indicating a size of paper loaded in the cassette. The paper tray may also have a dial or cassette for designating a paper size. Therefore, a paper tray according to the present invention includes, but is not limited to, cassettes and manual feed trays, each of which may be configured according to the present invention.

The new paper tray 60 includes fully adjustable paper guides 61 and position setting identifiers 17. The fully adjustable paper guides 61 are not limited to any particular number of position settings, and the position setting identifiers 17 are provided only for reference for a predetermined number of standard or precut paper sizes. The paper guides 61, if desired, are implemented in any conventional manner and may utilize any structure, as long as different paper sizes are accommodated in the paper tray 60. As an alternative to being fully adjustable, the paper guides 61 are implemented to having a limited amount of adjustment, if desired.

Paper 21 is loaded into the new paper tray 60 by moving the fully adjustable paper guides 61 to match a size of paper 21, placing paper 21 in the new paper tray 60, and positioning a dial selector with an asterisk position 63 to a position corresponding to a size of paper 21. Paper 21 can be of any number of standard or precut paper sizes, for example 8½×11, 11×14, or 14×17 (A, B or C as shown in FIG. 6A). Another standard size is A4, although the present invention is not limited to any specific standard size. Standard size, as used herein, is simply a size which is generally available. The size of paper 21 can also be of an alternate size not present on the dial selector 63, in which case, the user positions the dial selector 63 to the asterisk position. The asterisk position on the dial selector 63 is utilized to indicated page size selection via a means other than the dial selector 63. Therefore, the asterisk could be any symbol or label, such as a checkmark, plus sign, graphic image, a textual designation such as "other" or "user defined", or even a lack thereof. As an alternative to the dial selector 63, any suitable mechanical, electrical, or electro-mechanical device may be used such as sliding mechanical switch or electrical switches.

Figure 6B:
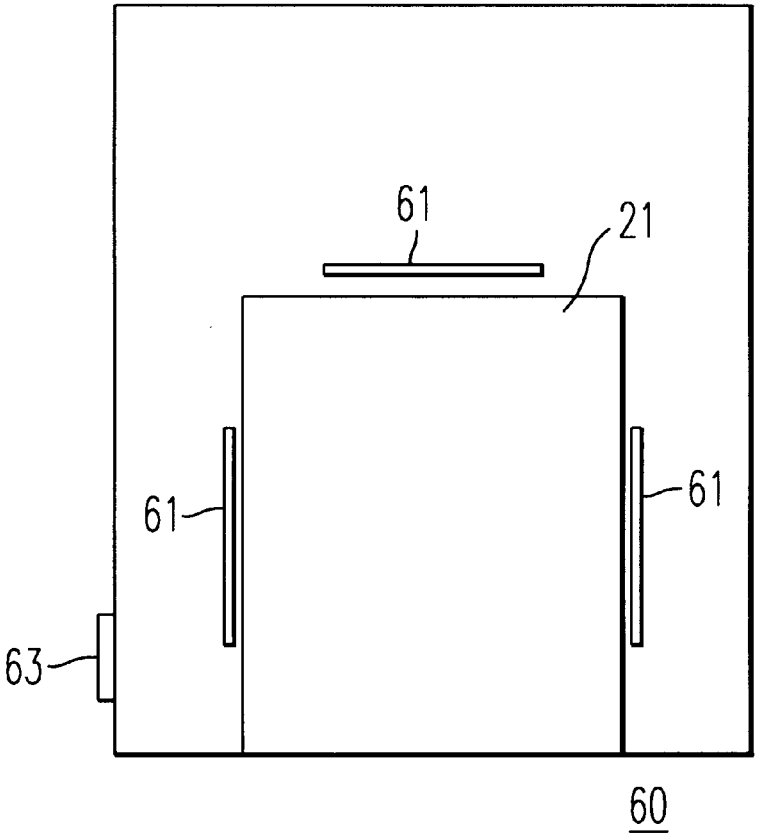
FIG. 6B illustrates an alternative paper tray according to the present invention utilizing adjustable paper guides and a dial selector with an asterisk position.
Figure 6C:
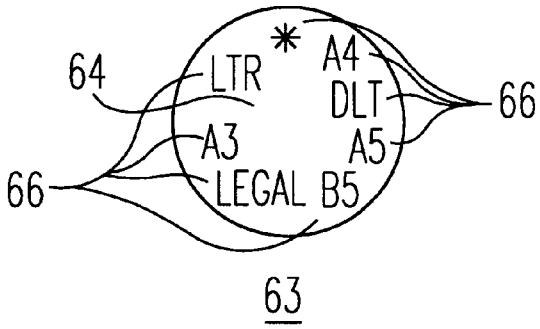
FIG. 6C illustrates one possible configuration of the dial selector utilized in the alternative paper tray of FIG. 6B.

FIG. 6B illustrates an alternative configuration of the paper tray 60 having fully adjustable paper guides 61 on three sides of paper 21 placed in the tray. One possible configuration of the dial selector 63 is illustrated in FIG. 6C that shows a wheel shaped dial 64 having position markings 66 indicating paper sizes and an asterisk position.

FIG. 7A(1) illustrates a paper size menu 73 and a keypad 77. The paper size menu 73 appears on a display panel 76 and lists alternate paper sizes from which the user makes a selection according to a paper size menu selection prompt 75 on the paper size menu 73. The user selection of paper size from the paper size menu 73 may be made by entering appropriate digits on the keypad 77 or any other means for making a selection, including, for example, mechanical pushbuttons, or graphical selection via a pointing device, etc, each of these means disposed on the printer and/or a computer connected to the printer.

As an alternative, the paper size menu 73 may be presented as shown in FIG. 7A(2), where a length/width selection is made corresponding to the paper 21 loaded in the paper tray 60. The length/width selection can be made directly from the paper size menu or alternatively from a secondary menu (see FIG. 10, for example). The length/width selection may include minimum/maximum values for either or both of the values to be input indicating a range of sizes that the paper tray 60 can accommodate.

In addition, the minimum/maximum values displayed may either be predetermined for a particular printer or determined based upon specifics of the paper tray 60. For example, the paper tray may have a mechanical or electrical switching device indicating paper sizes that may be accommodated, and the printer then senses that device and displays appropriate minimum/maximum values based thereon.

Figure 7B:
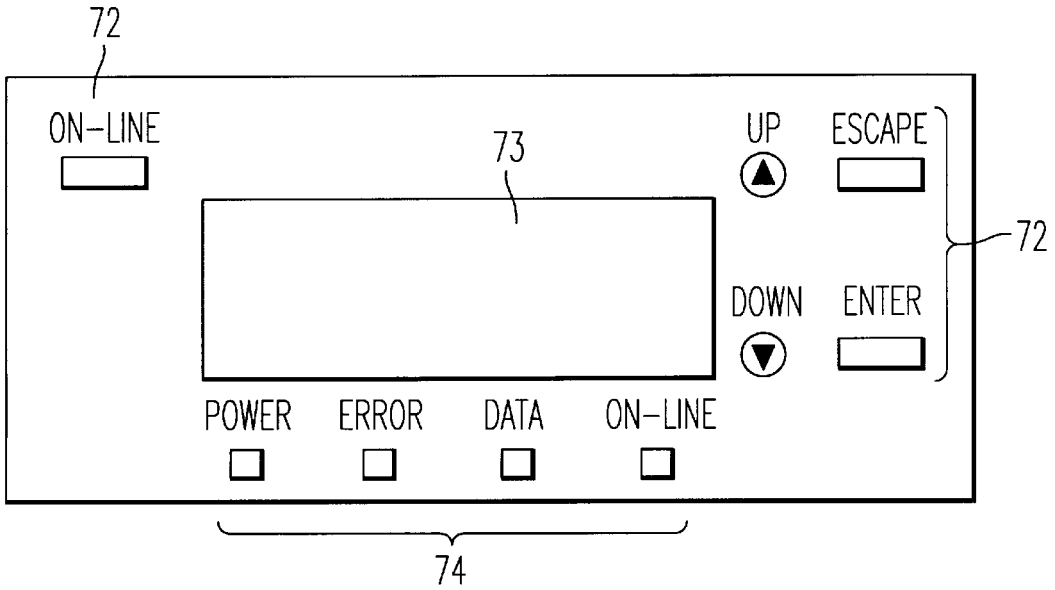
FIG. 7B illustrates an alternative display panel and key arrangement on a front panel of the printer.

As an alternative, the display panel 76 and keypad 77 may be arranged as shown in FIG. 7B. In this arrangement, the keypad includes pushbuttons 72 (up, down, escape, and on-line, for example), and indicator lights 74 (power, error, data, and on-line, for example).

Figure 8:
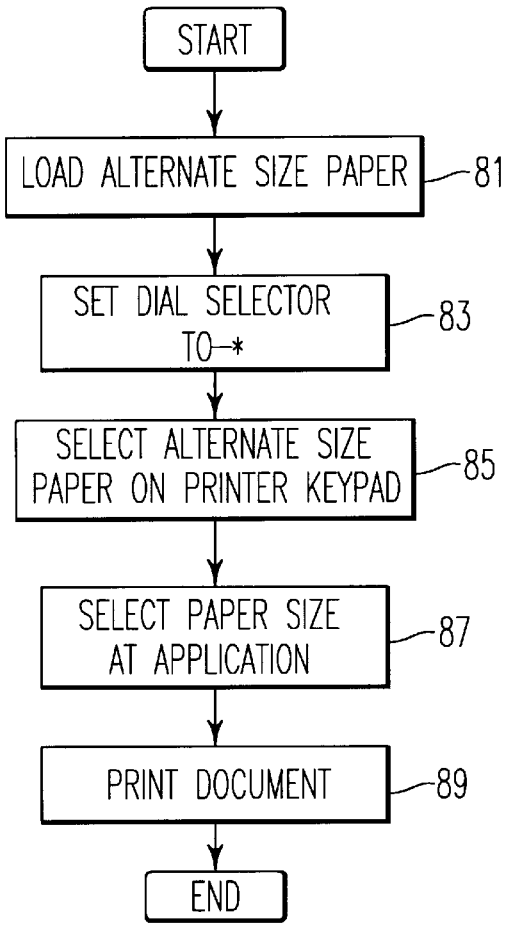
FIG. 8 is a flowchart illustrating the steps of loading paper of an alternate size into a printer according to the present invention and printing a document from an application.

FIG. 8 is a flowchart illustrating a method for printing on alternate size paper. At step 81, a user loads the alternate size paper into the new paper tray 60 by removing the new paper tray 60 from a printing device, adjusting the fully adjustable paper guides 61 according to a size of the alternate size paper, and loading the alternate size paper into the new paper tray 60. At step 83, the user positions the dial selector 63 to the asterisk position, and reinserts the new paper tray 60 into the printing device. As stated above, other labels may be used in place of the asterisk.

At step 85, the user selects the size of the alternate size paper from the paper size menu 73 by utilizing the keypad 77, thus registering the alternate size paper with the printing device. At step 87, the user then selects a paper size matching the alternate size paper using an application which is to print to the printing device by invoking a dialog box or other selection means on a computer and making appropriate selections. Finally, at step 89, the user invokes a print command sequence after which the application sends the document to be printed on alternate size paper to the printing device.

The above steps are illustrative and do not necessarily need to be performed in the order presented. In addition, some steps may not be necessary, for instance, an application that does not require separate commands for selection of page size and printing may not require step 87, and each step may be modified depending on the specifics of the application and/or physical configuration of the printing device utilized. For example, rather than a keypad 77 and paper size selection prompt 75 as shown in FIG. 7A(1), the printer may utilize a graphical user interface and a pointing device, mechanical pushbuttons, or other alternate selection means to select paper sizes.

Figure 9:
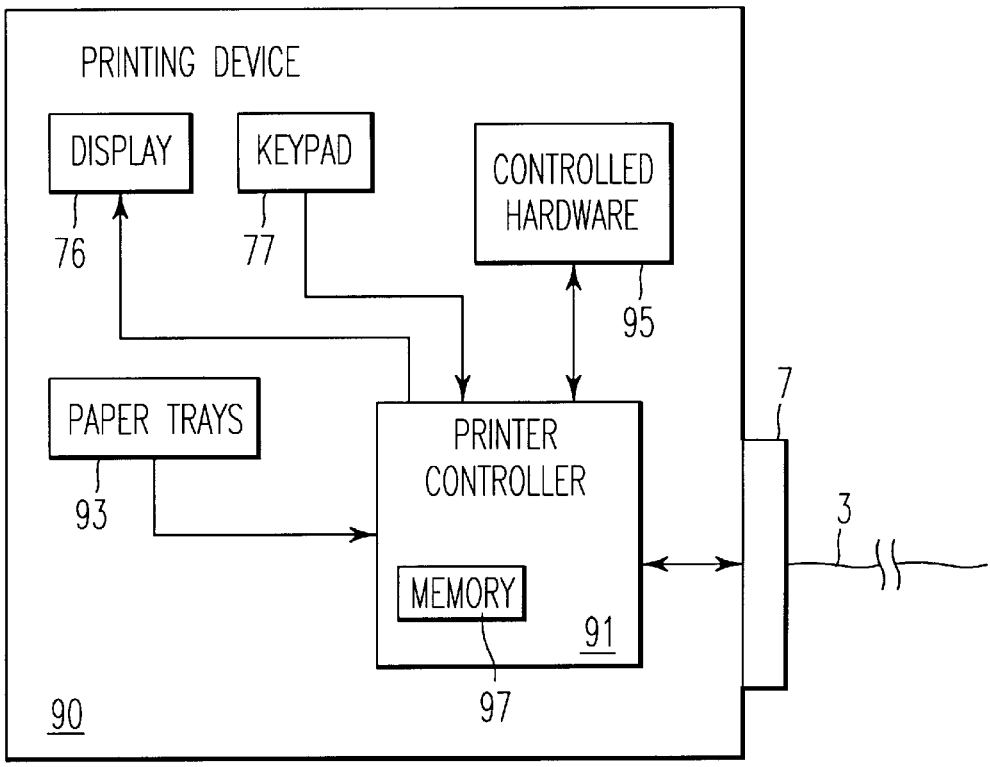
FIG. 9 is a block diagram of a printer according to the present invention.

FIG. 9 illustrates a printing device 90 according to the present invention. The printing device 90 includes paper trays 93 which include at least one new paper tray 60, a display panel 76, keypad 77, controlled hardware 95, such as a printing engine, printer controller 91, memory 97, and printer connection port 7. The printer controller inputs data from the paper trays 93, including a dial selector position corresponding to sizes of paper loaded therein. For example, the dial selector 63 may move mechanical arms, or a wheel that activates mechanical pushbuttons or make electrical connections when the new paper tray 60 is inserted into the printing device. Any suitable manner of communicating the selected paper size to the printer may be utilized, including all known manners of communicating size selection information and any desired manner of communicating size information.

The printer controller 91 also sends data to the display panel 76, for instance, when the user selects the asterisk position on the dial selector 63, the printer controller 91 sends commands to the display panel 76 to display, for example, the paper size menu 73, as shown in FIG. 7A(1). The printer controller 91 also receives data from the keypad 77, for example, the user selection of an alternate paper size keyed into the keypad 77 in response to display of the paper size menu 73.

Alternatively, the printer may not send data to the display panel when the user selects the asterisk position on the dial selector 63. In this case, the printer is preprogrammed so that the asterisk position is associated with a specific paper size, and the user is required to enter a menu mode in order to change the paper size corresponding to the asterisk. Therefore, the user need not enter a new paper size each time the asterisk position is selected, unless a different custom cut paper size has been loaded into the printer.

The printer controller 91 also sends and receives signals from the controlled hardware 95, such as toner level indicators, controlled motors, and other controlled hardware maintained and normally found in a printing device. The printer controller 91 also includes the memory 97 in which important information is stored including user selections, for example, user entries from the keypad 77, and any other data and/or programs needed for the operation of the printer controller 91 and printing device 90. The printer connection port 7 is connected to the printer controller 91 and to the cable and/or other network 3 from which documents or other items to be printed are received. The cable and/or other network may be implemented using any desired manner of communicating signals to the printing device 90 such as a serial cable, parallel cable, any network cable, telephone line, a cable specially designed to carry printing signals such as a cable connected to a printing device used as a copier, wireless connections such a infrared, radio frequency, or any desired manner of transmitting signals.

The configuration of printing device 90 may vary substantially from that illustrated in FIG. 9. Virtually any modern printing device may be substituted and modified according to the present invention because all such devices have a configuration capable of similar functionality or may be easily modified to include functionality equivalent to that described herein.

Figure 10:
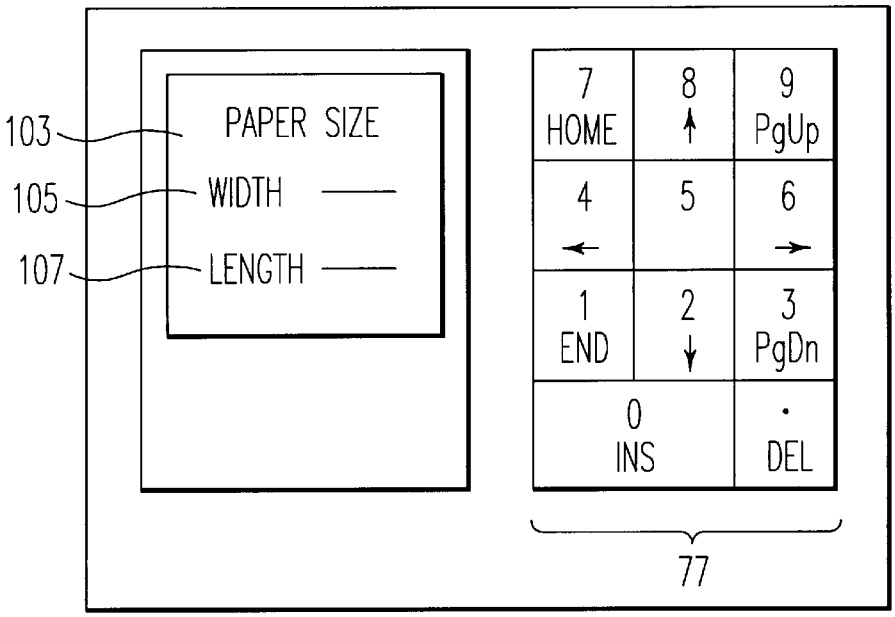
FIG. 10 illustrates a custom cut page size menu and keypad invoked and utilized upon selection of "other" from the page size menu.

Referring now to FIG. 10, in the case where the user selects "other" or another designation indicating an unlisted size or an undefined size from the paper size menu 73, the printer controller 91 displays a custom cut size menu 103 on the display panel 76. The custom cut size menu includes entry positions for width 105, and length 107. The width 105, and length 107 are entered via the keypad 77. However, such entries may also be made via any number of known entry techniques including a graphical user interface and pointing device, slide bars, pushbuttons, etc. Further, in addition to entering the size of a paper, a name corresponding to the paper size may be entered for reference purposes. The custom cut size menu 103 allows the user to select any custom cut page size that may be fit into the new paper tray 60, as the paper size menu 73 is not intended to be an exhaustive list of possible paper sizes.

Figure 11B:
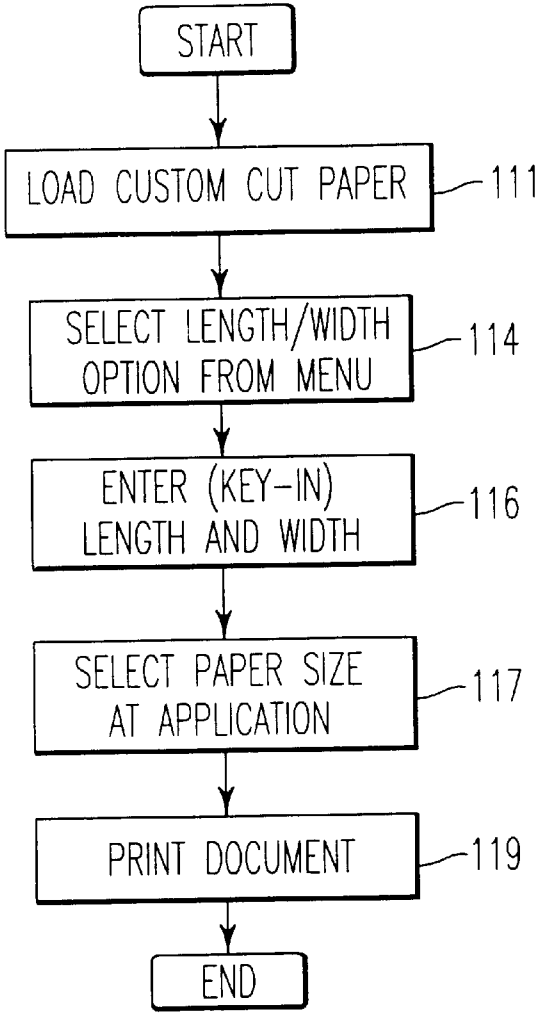
FIG. 11B is a flowchart illustrating steps necessary to load and select a custom cut paper utilizing the alternative paper size menu.
Figure 11A:
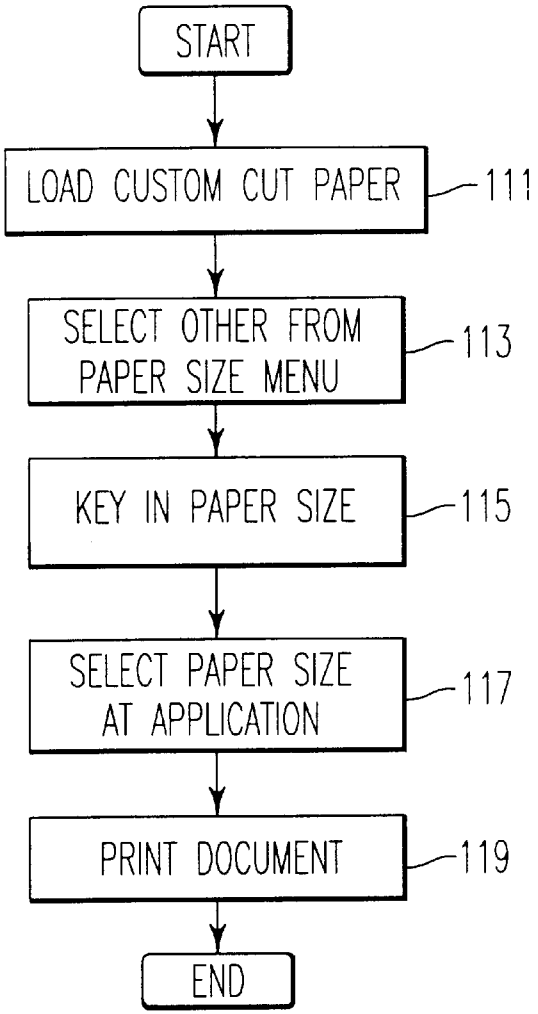
FIG. 11A is a flowchart illustrating the steps necessary to load and select a custom cut paper size and print from an application on the custom cut paper.

FIG. 11A is a flowchart illustrating steps for loading custom cut paper and printing thereon. At step 111, a user loads custom cut paper into the new paper tray 60 which includes removing the new paper tray 60, adjusting the fully adjustable paper guides 61 according to the custom cut paper, placing the custom cut paper into the new paper tray 60, selecting the asterisk position on the dial selector 63, and reinserting the new paper tray 60.

At step 113, the paper size menu is displayed, the user selects "other" from the paper size menu 73 by entering a corresponding selection number at the keypad 77 as directed by the paper size selection prompt 75. Similar to the asterisk position on the dial selector 63, use of "other" as a selection from the paper size menu 73 may alternatively be any symbol or label and is not intended to be limited to "other".

In response to the selection of "other", the printer controller 91 displays the custom cut size menu 103 on the display panel 76. At step 115, the user keys in the paper size including width 105 and length 107 of the custom cut paper.

At step 117, the user selects the paper size for the document to be printed at a wordprocessor or other application associated with the document to be printed. And finally, at step 119 the user invokes the print command for printing the document.

FIG. 11B is a flowchart illustrating steps necessary to load and select a custom cut paper utilizing the alternative paper size menu. At step 114 a selection of a length/width option is made. At step 116, length and width corresponding to the custom cut paper is entered (keyed in) to the printing device. Steps 111, 117, and 119 operate as described in reference to FIG. 11A.

Figure 12:
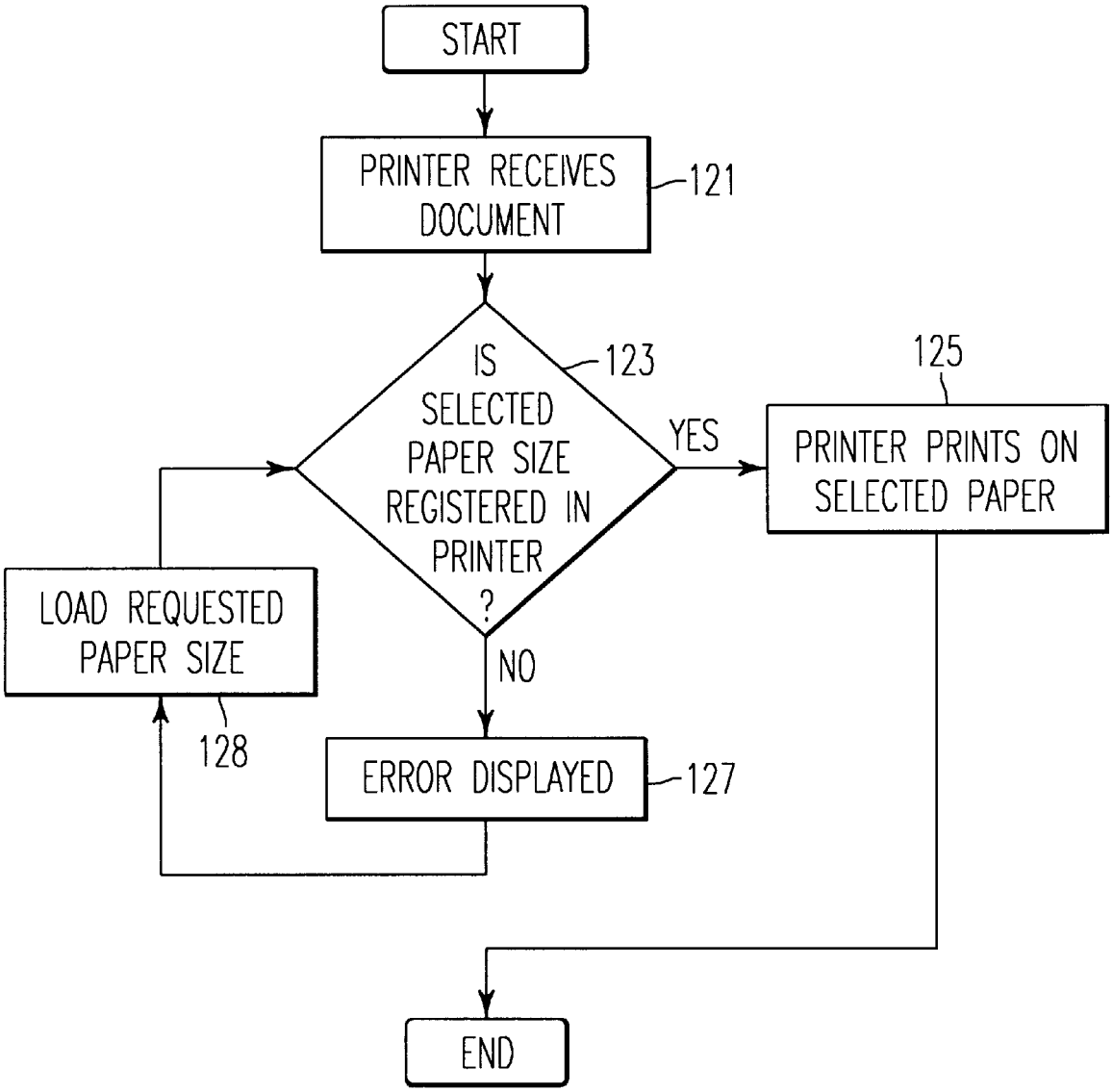
FIG. 12 is a flowchart illustrating a process of detecting a paper size error.

FIG. 12 is a flowchart illustrating a process of detecting a paper size error. This occurs when a user prints a document to the printing device 90 without loading a correct size paper or other material.

At step 121, the printer receives the document to be printed. At step 123, the printing device 90 determines whether or not a paper or other material of a size associated with the document is registered in the printing device 90. If available, at step 125, the printing device 90 prints the received document on the paper or other material of a size associated with the document.

In the case where the paper or other material of a size associated with the received document is not available, at step 127, an error message is displayed indicating that the user should load the paper or other material of a size associated with the document into the printing device 90. At step 128, the requested paper size is loaded, and the paper size determination at step 123 is again performed.

As with each of the explanations above, the steps illustrated are not necessarily performed in the order presented, and each step may vary depending upon such items as user preference, specifics of the wordprocessor or other application utilizing the printing device, or other known variations of display panels or other printing hardware.

Portions of this invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Any portion of the present implemented on a general purpose digital computer or microprocessor invention includes a computer program product which is a storage medium including instructions which can be used to program a computer to perform a process of the invention. The storage medium can include, but is not limited to, any type of disk including floppy disks, optical discs, CD-ROMs, and magneto-optical disks, ROMs, RAMs, EPROMs, EEPROMs, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A paper tray, comprising:

a paper area for loading paper; and a selector having plural user selectable positions identifying a size of paper loaded in the paper area, including, at least one position identifying a standard paper size, and a position utilized to designate a plurality of paper sizes.

2. The paper tray according to claim 1, wherein said paper area further comprises adjustable paper guides that adjust to a length and a width of paper loaded into said paper area.

3. The paper tray according to claim 2, wherein said paper guides are fully adjustable and not dependent upon a predetermined number of paper positions.

4. A printing device, comprising:

a paper tray, having, a paper area for loading paper, and a selector having plural user selectable positions identifying a size of paper loaded in the paper area, including, at least one position identifying a standard paper size, and a position utilized to designate a plurality of paper sizes;

a means for reading the user selected position of the selector; and a means for selecting an alternate paper size loaded into said paper tray utilized when the selector is at the position utilized to designate a plurality of paper sizes.

5. The printing device according to claim 4, wherein said means for selecting an alternate paper size includes a means for inputting dimensions of the alternate paper size.

6. The printing device according to claim 4, wherein said means for selecting an alternate paper size includes:

a means for displaying a predetermined list of alternate paper sizes on a display panel of the printing device when the user selected position of the selector is at said position designating a plurality of paper sizes; and a means for user selection of a paper size from the predetermined list of alternate paper sizes displayed.

7. The printing device according to claim 6, wherein:

said predetermined list of alternate paper sizes includes a selection of an unlisted size, and said printing device further comprising, a means for displaying a menu in response to a user selection of the unlisted size, and a means for inputting dimensions of the alternate paper size to the printing device.

8. The printing device according to claim 7, wherein said means for inputting the alternate paper size includes means for inputting at least a width and a length of the alternate paper size.

9. The printing device according to claim 8, further comprising a means for storing said alternate paper size input to the printing device.

10. A printing device, comprising:

a paper tray having an area for loading paper with adjustable paper guides;

a means for displaying a predetermined list of alternate paper sizes; and a means for user selection of a size of paper loaded into the paper tray from said predetermined list of alternate paper sizes displayed in order to register with the printing, device the size of the paper loaded into the paper tray.

11. The printing device according to claim 10, wherein:

said paper tray includes a selector having, a position for identifying a standard paper size, and an alternate position for identifying a paper size from said predetermined list of alternate paper sizes; and said means for user selection comprises, a display of said predetermined list of alternate paper sizes displayed in response to said selector being placed in said alternate position, and a means for inputting a user selection from said predetermined list of alternate paper sizes to said printing device.

12. The printing device according to claim 11, wherein:

said predetermined list of alternate paper sizes includes a selection of an unlisted size; and said printing device further comprising, a means for displaying a paper size menu on said display panel in response to a user selection of said unlisted size from said predetermined list of alternate paper sizes, and said means for inputting includes a means for inputting dimensions of the alternate paper size to said printing device when said paper size menu is displayed.

13. The printing device according to claim 12, wherein said means for inputting dimensions of the alternate paper size includes means for inputting length and width of the alternate paper size.

14. A method for printing, including the steps of:

loading a paper tray with a medium to be printed on;

positioning a size indicating device to one of a position indicating a standard size and a position indicating a plurality of sizes;

defining a size corresponding to a size of said medium when said size indicating device is positioned at the position used to indicate a plurality of sizes; and registering said size of said medium in a printing device utilizing said paper tray.

15. The method according to claim 14, wherein said step of defining comprises the substep of:

entering dimensions of said size corresponding to a size of said medium into a device for registering said size corresponding to said medium with said printing device.

16. The method according to claim 15, wherein said step of defining further comprises the step of displaying a page size menu for identifying said dimensions to be entered at said entering step.

17. The method according to claim 14, wherein said step of loading includes the substep of adjusting at least one paper guide according to said size corresponding to said medium.

18. The method according to claim 14, wherein said step of defining includes the substeps of:

displaying a predetermined list of alternate paper sizes on a size selection menu; and selecting said size corresponding to said medium from said predetermined list of alternate paper sizes displayed.

19. The method according to claim 14, wherein said step of defining includes the substeps of:

displaying a predetermined list of alternate paper sizes including a selection of an unlisted size;

selecting the unlisted size from the predetermined list of alternate paper sizes;

displaying a page size menu;

entering a size corresponding to said medium at said page menu.

* * * * *